US007193508B2

(12) United States Patent
Hill et al.

(10) Patent No.: US 7,193,508 B2
(45) Date of Patent: Mar. 20, 2007

(54) PORTABLE SECURITY SYSTEM

(76) Inventors: Philip A. Hill, 3221 Adell Dr., Urbana, OH (US) 43078; Steven M. Schneider, 44 Rue St. Clair, Urbana, OH (US) 43078

( * ) Notice: Subject to any disclaimer, the term of this patent is extended or adjusted under 35 U.S.C. 154(b) by 183 days.

(21) Appl. No.: 11/056,690

(22) Filed: Feb. 11, 2005

(65) Prior Publication Data

US 2005/0179539 A1 Aug. 18, 2005

Related U.S. Application Data

(60) Provisional application No. 60/544,008, filed on Feb. 12, 2004.

(51) Int. Cl.
*G08B 21/00* (2006.01)

(52) U.S. Cl. ..... 340/431; 340/506; 340/517; 340/521

(58) Field of Classification Search ..... 340/431, 340/506, 517, 521, 540
See application file for complete search history.

(56) References Cited

U.S. PATENT DOCUMENTS

| | | | | |
|---|---|---|---|---|
| 3,914,756 | A | 10/1975 | Seyk | |
| 5,200,735 | A | 4/1993 | Hines | |
| 5,463,595 | A | 10/1995 | Rodhall et al. | |
| 5,850,180 | A | 12/1998 | Hess | |
| 6,049,273 | A | 4/2000 | Hess | |
| 6,181,244 | B1 | 1/2001 | Hall et al. | |
| 6,484,456 | B1 * | 11/2002 | Featherstone et al. | 52/118 |
| 6,831,557 | B1 | 12/2004 | Hess | |
| 2003/0025791 | A1 | 2/2003 | Kaylor et al. | |

FOREIGN PATENT DOCUMENTS

| | | | |
|---|---|---|---|
| EP | 0920211 | A2 | 6/1999 |
| JP | 8280004 | A2 | 10/1996 |
| JP | 2002373390 | A2 | 12/2002 |
| JP | 200385238 | A2 | 3/2003 |
| WO | WO 9529470 | A1 | 11/1995 |
| WO | WO 9908244 | A1 | 2/1999 |
| WO | WO 0159517 | A1 | 8/2001 |
| WO | WO 0169565 | A2 | 9/2001 |
| WO | WO 03043316 | A1 | 5/2003 |

* cited by examiner

*Primary Examiner*—Daryl C Pope
(74) *Attorney, Agent, or Firm*—Eley Law Firm Co.; James R. Eley; Michael A. Forhan

(57) ABSTRACT

A portable security system. The portable security system includes a wheeled trailer and a telescopic mast that is coupled to the trailer. The mast is pivotable between a first generally horizontal retracted position and a second generally vertical extended position. A cabinet is mounted onto the trailer and houses a control subsystem, a data input subsystem, a data server and a data storage subsystem. At least one input device is connected to the data input subsystem. The data input subsystem receives data from the input device and forwards the data to the data storage subsystem for storage by means of the data server.

15 Claims, 4 Drawing Sheets

PORTABLE SECURITY SYSTEM

This application claims priority to U.S. provisional application 60/544,008, filed Feb. 12, 2004, the contents of which are hereby incorporated by reference.

FIELD

This invention relates to security systems. In particular, this invention relates to portable security systems having self-contained data acquisition, storage, and transfer capabilities, as well as remote control capability.

BACKGROUND

The typical construction site includes a variety of valuable items, including equipment, tools and materials. These items are often expensive to replace or repair if damaged by vandals or stolen. In addition, the time required to repair or replace the items can cause a construction project to lag behind it projected schedule. This is a particular concern for construction projects governed by contracts that include penalties for delays, or where progress payments to the construction company are based upon completion of certain phases of the project.

Construction sites can also be hazardous environments for unauthorized personnel. For example, safety devices such as handrails may not yet be installed. Further, some unfinished structures may appear to be sturdy, but are in fact not yet capable of bearing the weight of a person. In addition, construction crews often leave large openings in walls and floors to facilitate the installation of subsystems such as wiring and plumbing. These openings can cause falls and serious injury to the uninitiated. Thus, there is a desire to secure the construction site to dissuade intruders.

Portable fencing is often used to secure a construction site. However, fences are easily breached by determined trespassers. One or more guards may be posted at the site, but this is an expensive solution, particularly if round-the-clock security is required. As an alternative, many construction sites include one or more surveillance cameras attached to a stationary object such as a telephone pole. However, the observable range of such cameras is necessarily fixed by the location of the pole. Even the addition of a servomotor mount to remotely reposition the camera may be unsatisfactory if the pole is not located near the area to be secured. In addition, the installation and wiring of such security cameras must be custom-configured to the peculiarities of the site, making installation time-consuming and difficult to move or disassemble when no longer needed.

Modern construction projects can be complex and involve personnel that are located remotely from the site, even in another state. Examples of such personnel include architects, material suppliers, construction supervisors, and the owner of the project. It is desirable for those personnel to be able to observe the construction site without having to be present at the site.

Surveillance systems are well-known in the art, such as the trailer-mounted surveillance system disclosed by Kaylor et al. in U.S. patent application Ser. No. 2003/0025791. Such systems are typically employed to provide a means for monitoring a predetermined area. However, surveillance systems, particularly portable surveillance systems, lack the capability to provide security to the area. Thus, while illegal and destructive activities, such as trespassing, theft and vandalism, may be detected by surveillance systems, little can be done to prevent these activities from occurring or to defend against them.

Others have attempted to provide portable security systems to protect a defined area, such as in U.S. Pat. Nos. 5,850,180, 6,049,273 and 6,831,557 to Hess. Such systems monitor alarm inputs, such as motion sensors and wireless switches, and contact a remote control station via a telephone link if a security breach is detected. However, known portable security systems do not provide remote users with the capability of surveilling conditions at a secured site in real-time, obtaining stored monitoring data relating to the site, changing security and monitoring protocols at the site, and actively changing or controlling conditions at the site to deter and/or thwart unauthorized activities.

There is a need for a portable security system that can be easily transported to a construction site and set up, then easily moved about the site as needed. There is a further need for a portable security system that requires little oversight. There is a still further need for a portable security system to provide visual contact with the construction site by personnel located remotely. There is a yet further need for a portable security system which overcomes the drawbacks of surveillance systems. A further need exists for a portable security system that can detect activity in a particular portion of a field of view and react by automatically providing notification to a designated authority through wired or wireless communication means and providing remotely located personnel with the capability to intervene and deter and/or thwart unauthorized activities.

SUMMARY

The present invention is a self contained, vandal-resistant portable security system having the capability to monitor a defined area with closed-circuit TV cameras, record the video and retain it for later review and use. The portable security system is mounted in its entirety to a transportable trailer with a collapsible telescopic mast for placement of cameras and other data input devices in a position to view the defined area. The system can be quickly erected and placed into operation. Likewise, it can be quickly stowed for travel.

The portable security system includes one or more data input devices such as cameras, a trailer with a telescopic mast, a battery power supply, a solar battery charging circuit, a digital video recorder, a server, and controls to activate the system. Data may be downloaded and reviewed using a conventional personal computer.

The portable security system further includes a cabinet mounted to the trailer that houses a communication subsystem, a data input subsystem, a control subsystem, a data server, a data storage subsystem and an output subsystem. The data server receives and digitally stores video and/or audio data. The server may be configured to overwrite the oldest stored data to conserve memory. In addition, a wired or wireless communication link may be coupled to the communication subsystem to facilitate transfer of various data such as video, audio, alarms, diagnosis, battery status and fault information from the portable security system to remote sites for review and storage. The communication link may also permit remote control of the portable security system, such as camera panning/focus, data uploading/downloading, server control, and activation of various output devices at the site, such as lights, alarms, motorized doors and locks, and so on.

In various embodiments the portable security system may include wireless Ethernet connectivity, Global Positioning System (GPS) interface with position reporting, cell phone integration for call-out on alarm notification, integration with Passive Infrared ("PIR") motion detectors and acoustical sensors for alarm inputs, and software growth capability for future functions such as biometric recognition, vehicle recognition, or smoke recognition. The design of the system also enables securing of large areas through use of a plurality of portable security systems networked together. Anti-theft and anti-vandalism protection is also provided to prevent harm to the portable security system by intruders and to preserve the integrity of data stored in the server.

An object of the present invention is a portable security system. The portable security system includes a wheeled trailer and a telescopic mast that is coupled to the trailer. The mast is pivotable between a first generally horizontal retracted position and a second generally vertical extended position. A cabinet is mounted onto the trailer and houses a control subsystem, a data input subsystem, a data server and a data storage subsystem. At least one input device is connected to the data input subsystem. The data input subsystem receives data from the input device and forwards the data to the data storage subsystem for storage by means of the data server.

Another object of the present invention is a portable security system. The portable security system includes a wheeled trailer and a telescopic mast coupled to the trailer. The mast is pivotable between a first generally horizontal retracted position and a second generally vertical extended position. A cabinet is mounted onto the trailer and houses a control subsystem, a data input subsystem, a data server, an output subsystem and a data storage subsystem. A battery power supply is also mounted onto the trailer to supply power to the portable security system. At least one input device is connected to the data input subsystem. At least one output device connected to the output subsystem and is actuable by the control subsystem by means of the output subsystem. The data input subsystem receives data from the input device and forwards the data to the data storage subsystem for storage by means of the data server. The control subsystem actuates an output device in response to a change in the status of an input device.

BRIEF DESCRIPTION OF THE DRAWINGS

Further features of the inventive embodiments will become apparent to those skilled in the art to which the embodiments relate from reading the specification and claims with reference to the accompanying drawings, in which:

DETAILED DESCRIPTION

Figure 1:
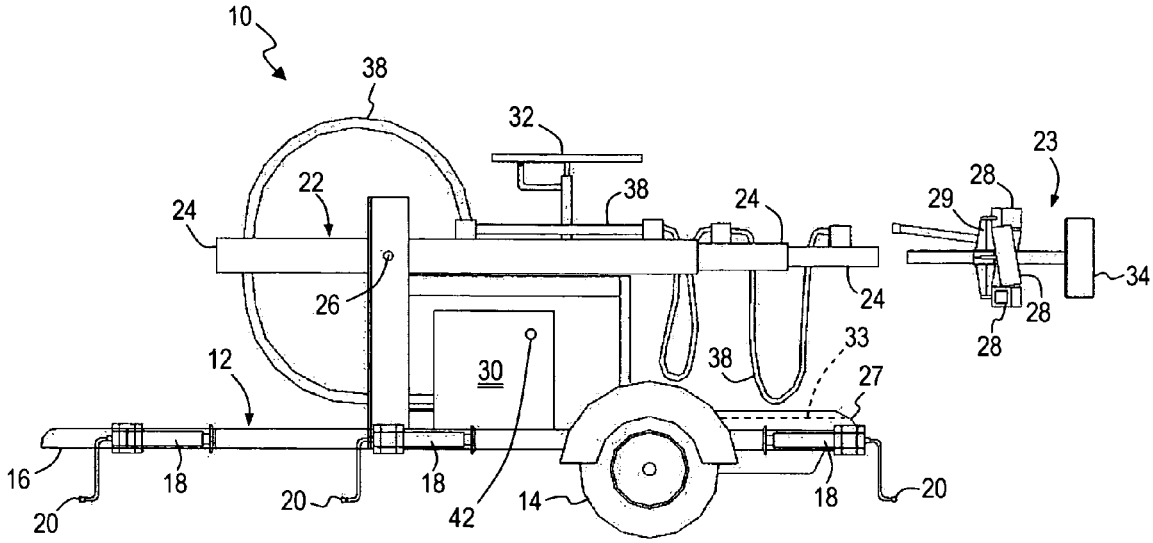
FIG. 1 illustrates a side elevational view of a portable security system in a stowed position according to an embodiment of the present invention.

A side elevational view of a portable security system 10 according to an embodiment of the present invention is shown in FIG. 1. Such a portable security system 10 may be provided in the form of a commercial product known as the VIDEO SNITCH™, as supplied by applicants or by at least one of their assignees or licensees. Portable security system 10 is shown in a stowed position in FIG. 1.

With continued reference to FIG. 1, a trailer 12 includes at least two wheels 14, a tongue 16 for connection to a tow vehicle (not shown), and a plurality of pivotable outriggers 18 to stabilize trailer 12 when the trailer is deployed. Outriggers 18 may be manually pivotable from a generally horizontal stowed position to a generally vertical deployed position, and may be retracted and extended to contact the ground by any conventional means, such as a handle 20.

A retractable telescopic mast 22 is mounted to trailer 12. Mast 22 includes at least one extendable section 24, and is pivotable upon a pivot point 26, allowing it to be stowed in a generally horizontal position for storage, movement or transport. A device mounting portion 23 may be made detachable from mast 24 during transportation and/or storage of portable security system 10 to prevent damage to data input devices due to excessive shock or moisture intrusion from unusual device attitudes.

At least one input device, such as a camera 28, is attached to mast 22. Camera 28 may be a still, video or thermal camera, and may provide monochromatic or color images. Any conventional data format may be utilized, including NTSC and PAL formats. Alternatively, camera 28 may be part of a night vision imaging system ("NVIS") that captures visual data under low-light conditions. In addition, camera 28 may include a one- or two-axis servo mount 29 to provide a user with remote control over the camera's field of view. Common controls for camera 28, such as pan, tilt, zooming and focus, may be remotely accessed and adjusted by means of a communication link 36 (FIG. 3), discussed below.

An enclosed battery box 27 has one or more compartments to contain at least one conventional battery 33 to provide stand-alone electrical power for portable security system 10. Battery box 27 is preferably ventilated and includes a detachable or hinged cover that may be secured to prevent theft or vandalism. Battery box 27 is preferably made of sturdy, corrosion-resistant materials such as steel, composites and engineered plastics and is constructed to be weatherproof. Battery box 27 may be made an integral part of trailer 12 or fabricated separately and attached to the trailer. Battery box 27 is configured such that batteries 33 are positioned at or below the deck level of trailer 12 for protection from tampering or damage, and to help maintain a low center of gravity for stability of the trailer.

Batteries 33 are preferably capable of maintaining operation of portable security system 10 for a specified amount of time with no external power applied. Batteries 33 may be recharged from electrical mains electrical mains via an external environmentally protected power plug (not shown). Portable security system 10 may also be operated from the electrical mains, if desired. In one embodiment twelve six-volt deep-cycle batteries 33 are used. Batteries 33 are wired in a series/ parallel configuration to yield a 12 volt output and are housed in two compartments of battery box 27, with six batteries in each compartment. Batteries 33 are secured by hold-down brackets in the compartments.

A lockable cabinet 30 houses the control, communications, data input, data transfer, data storage and output subsystems of portable security system 10. Each of these subsystems are discussed in further detail below. Cabinet 30 is preferably made of a sturdy material that is resistant to exposure to the environment and tampering, such as steel, composites and engineered plastics.

Portable security system 10 may be equipped with a series of locks to prevent theft and tampering. Locks may be used to secure mast 22 and any associated pivoting mechanisms such as a winch, outriggers 18, battery box 27, and a hitch portion of tongue 16. The locks may be configured such that a single key will unlock each lock. In one embodiment three keys are utilized with portable security system 10. A first key operates the locks. A second key provides access to cabinet 30. A third key is used to control a key-actuated electrical switch activate portable security system 10.

Figure 2:
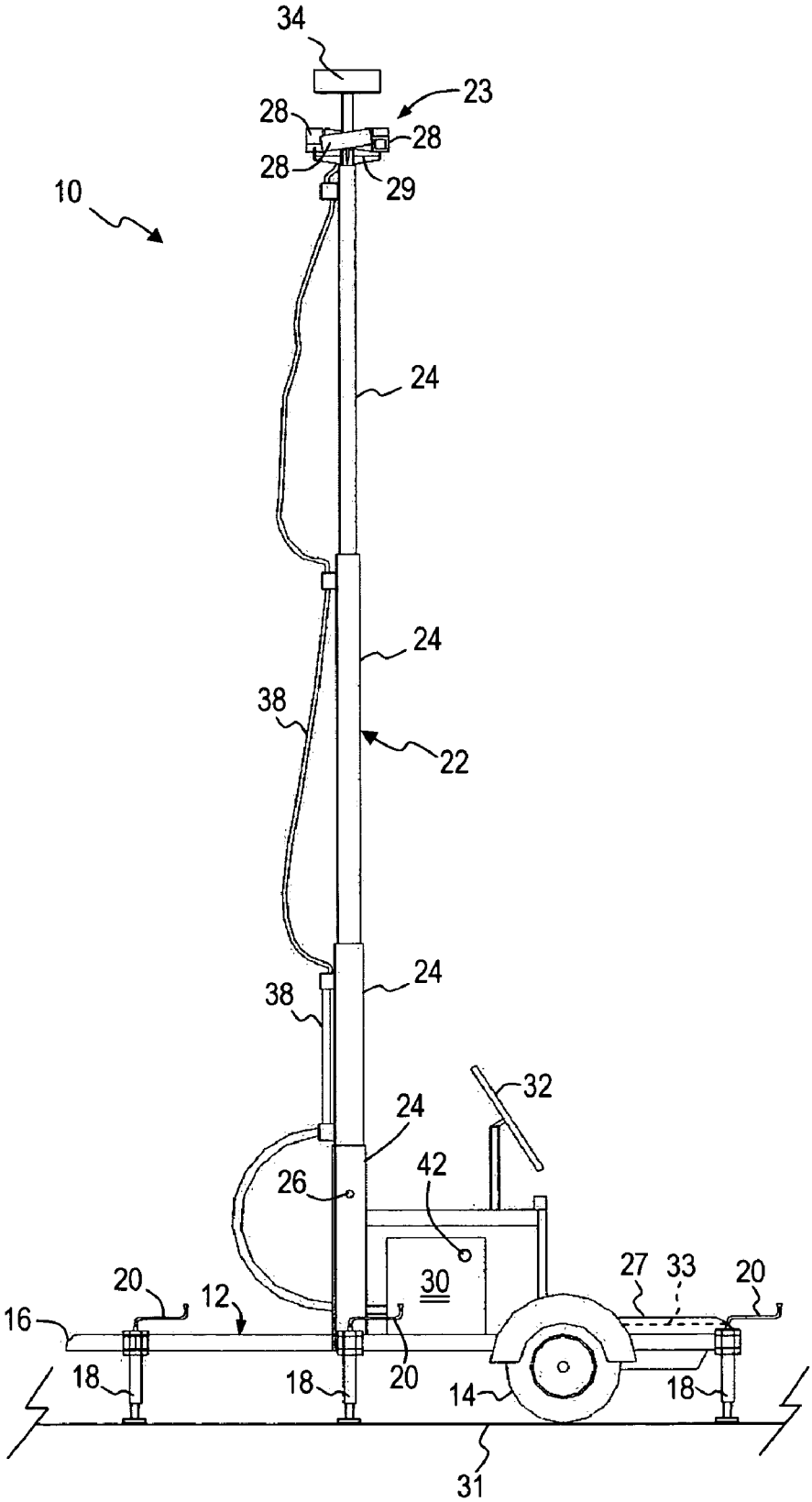
FIG. 2 depicts a side elevational view of the portable security system of FIG. 1 in a deployed position.

FIG. 2 depicts portable security system 10 in a deployed position. As can be seen, outriggers 18 are oriented generally vertically and are in an extended position, engaging the ground 31 to stabilize portable security system 10. Mast 22 is pivoted to a generally vertical orientation and one or more mast sections 24 are extended such that cameras 28 are elevated for a clear field of view. A stowable, pivotable solar panel 32 may be provided to augment the power supplied to portable security system 10 by batteries 33 in battery box 27 and/or recharge the batteries. Solar panel 32 may be oriented vertically and horizontally for optimum reception of solar energy. A charge controller may be included with solar panel 32 to protect batteries 33 from overcharge and excessive discharge conditions.

Various components of portable security system 10 may be adapted to discourage tampering by unauthorized personnel. For example, exposed cabling may be covered with rigid or flexible plastic or metal sheathing 38 (FIGS. 1 and 2) to prevent disengagement or cutting of the cables. Access points, such as access panels, may be locked using conventional locking devices. Various hardware components may include conventional types of security screws, bolts and nuts, as well as conventional tamperproof fasteners.

Figure 3:
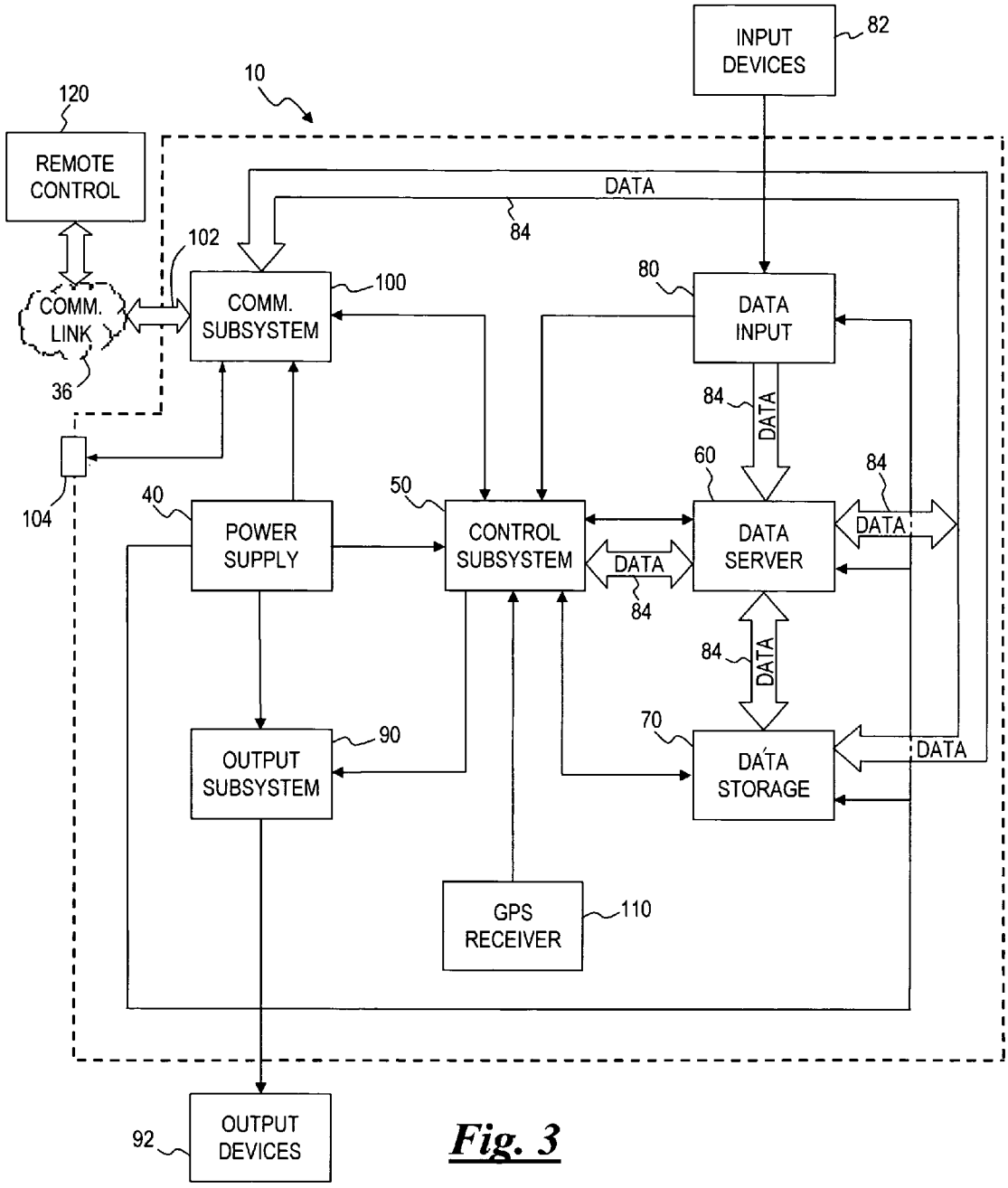
FIG. 3 is a functional block diagram of a portable security system according to an embodiment of the present invention.

A functional block diagram of portable security system 10 is shown in FIG. 3 according to an embodiment of the present invention. Portable security system 10 comprises a power supply 40, a control subsystem 50, a data server 60, a data storage subsystem 70, a data input subsystem 80, an output subsystem 90 and a communications subsystem 100. Details of each of these subsystems are provided below.

Power supply 40 may include a DC and/or AC power source, such as batteries 33 (FIGS. 1 and 2), AC/DC converters, DC/AC inverters, AC mains and solar panel 32 (FIG. 2). An external generator (not shown) may optionally be coupled to power supply 40 to supply power to portable security system 10 and/or charge batteries 33. If batteries 33 are used, they are preferably housed in battery box 27 to prevent tampering by unauthorized personnel.

Control subsystem 50 operates in accordance with a set of predetermined instructions, such as a computer program stored in a memory portion of the control subsystem and/or data storage subsystem 70, or in accordance with instructions received from a remote external control 120, also termed "remote control." Control subsystem 50 acts in accordance with the instructions to control the operation of any or all of power supply 40, data server 60, data storage 70, data input 80, input devices 82, output subsystem 90, output devices 92, and communications subsystem 100. Control 50 may, using the predetermined instructions, apply predetermined equations and algorithms to analyze data present at data input 80 and/or data stored in data storage subsystem 70 in order to determine whether a security breach has occurred. Such analyses may include comparisons between current and stored data to determine whether a change in the status of data being generated by an input device has occurred. Control subsystem 50 may include any conventional type of microprocessor, microcomputer, central processing unit, or computer. Control subsystem 50 facilitates the operation of portable security system 10 in accordance with a set of predetermined instructions, such as a computer program (not shown) stored in either or both a memory portion of the control subsystem and data storage subsystem 70. The instructions may relate various operational aspects of portable security system 10 including, without limitation, control of data input devices 82, monitoring protocols and priorities for data from the input devices, responses to security breaches, transfer of data to and from data storage subsystem 70, control of power supplied to various subsystems and input devices, providing status and input device information to a remote control 120, fault detection and remediation, and control of output devices 92.

An internal clock of control subsystem 50 may be synchronized with the internal clock of a remote control 120, discussed below. The internal clock may also be configured to automatically update for daylight saving time in various time zones.

Control subsystem 50 may also include an alarm handling system that can be armed and disarmed by either a timer or an alarm input. In addition, arm and disarm time periods for each day of the week may be provided, as well as holidays and other predetermined dates, which can be user-definable. A user-settable post-alarm time can be implemented wherein incoming data may be recorded at a higher rate of speed and/or resolution for a predetermined period of time after an alarm signal has been removed from data input subsystem 80.

Data server 60 functions in cooperation with data storage subsystem 70 to store and retrieve data provided by data input subsystem 80. Data from one or input devices 82 is provided to data input subsystem 80. The data is forwarded to server 60, which transfers the data to data storage subsystem 70. Likewise, data server 60 may transfer data stored in data storage subsystem 70 to a remote control 120 by means of communications subsystem 100 and a communication link 36. Likewise, server 60 may forward real-time data from data input subsystem 80 to remote control 120 by means of communications subsystem 100 and communication link 36. Data server 60 may be configured to overwrite the oldest stored data in data storage subsystem 70 to conserve memory, and may be configured to generate watermark reports in order to provide verifiable evidence for law enforcement activities. Data server 60 may be any conventional type of server adapted to receive, store and transmit data.

Data storage subsystem 70 receives data from data input subsystem via server 60. Alternatively, data from an external source may be received by communications subsystem 100 and forwarded to data storage subsystem 70 via server 60 or directly. Data stored in data storage subsystem may be retrieved via server 60 or directly. Data storage subsystem 70 may be any conventional type of electronic data storage device including, without limitation, hard drives, solid state storage, magnetic tape, random access memory, read only memory, volatile memory and non-volatile memory.

Data input subsystem 80 receives data gathered from at least one source, such as cameras 28 or other input devices 82. The data may be in any standard or proprietary digital or analog format. Data input subsystem 80 performs any data conversion needed, such as analog-to-digital conversion, data bus formatting, level shifting and polarity shifting, and forwards the data to data storage subsystem 70 via data server 60 for storage.

Figure 4:
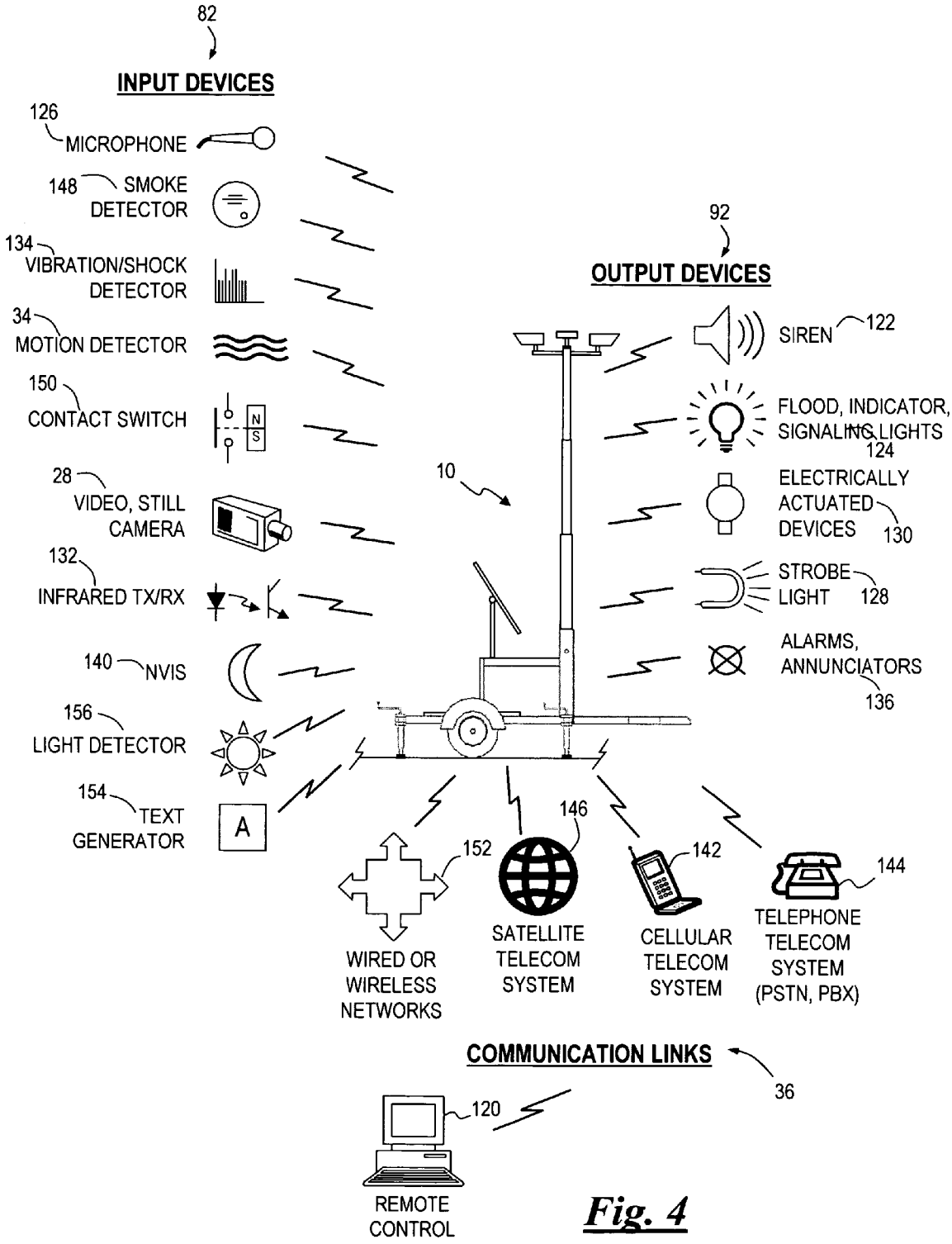
FIG. 4 shows a general overview of input, output and communication interfaces with a portable security system according to an embodiment of the present invention.

With reference to FIGS. 3 and 4, examples of input devices 82 include, without limitation, cameras 28 providing at least one of analog and digital video and/or still picture data in color and/or monochromatic formats; NVIS images 140; audio microphones 126; PIR motion detectors 34; infrared transmitters/receivers 132; vibration/shock detectors 134; smoke detectors 148; contact switches 150; alphanumerical data 154 from text generating devices such as ticket machines, scanners and access control devices, and light detectors 156.

With regard to microphone 126, audio may optionally be recorded and synchronized with video from an associated camera 28 when stored in data storage subsystem 70. In various embodiments data input subsystem 80 may provide conventional "phantom" power or clean-power microphone interfaces to microphone 126, and may be configured to accept line-level signals or microphone-level audio inputs.

Data provided by input devices 82 may include an alarm signal, such as motion detector 34. Control subsystem 50 can be configured to monitor for the presence of an alarm signal at data input 80, and undertake a predetermined course of action when an alarm signal is detected, such as notifying a remote control 120 or simply record a time notation in an event data base portion of data storage 70.

Input devices 82 may be coupled to input subsystem 80 by either wired (i.e., analog and/or digital electrical signals) or wireless (i.e., RF and optical transmit and receive signals). Data input subsystem 80 may include multiplexed data inputs, allowing connection of synchronized or unsynchronized data input devices 82. Data from input devices 82 may be individually enabled and disabled by control 50 in accordance with a set of predetermined instructions, such as a computer program. Faults of input devices 82 may be detected by control system 50, and control system may disable faulty inputs at data input subsystem 80. Each input device 82 may have a user-modifiable title for tracking of data stored in data storage subsystem 70.

A data bus 84 provides for bidirectional data transfer between control subsystem 50, data server 60, data storage subsystem 70, data input subsystem 80 and communications subsystem 100. Data bus 84 may be any type of conventional serial or parallel data bus, and may conform to a standard or utilize a proprietary format.

Output subsystem 90 serves as an interface between control subsystem 50 and output devices 92 for the purpose of controlling the equipment. Output subsystem may include any conventional form of analog or digital signal and power control suitable for operating output devices 92 including, without limitation, electromechanical and solid state relays, wireless infrared or RF transmitters, network connections, and full- and half-bridge switch arrays. Example output devices 92 include, without limitation, sirens 122; flood, indicator and signaling lights 124; strobe lights 128; electrically actuated devices 130 such as camera focusing, zoom and servo-motor positioning devices, doors, gates and latches; and visual and aural alarms and annunciators 136.

Communications subsystem 100 provides control subsystem 50 with means for both transmitting and receiving data to and from portable security system 10. Communications subsystem 100 may include one or more conventional means for data communications including, without limitation, cellular telecommunications systems 142; PSTN and PBX telephone telecommunications systems 144; satellite telecommunication systems 146; and wired and wireless data networks 152 such as intranets, Ethernet connections and the internet. Data may be transmitted and received by communications subsystem 100 via one or more ports 102 in any conventional format including, without limitation, analog signals, digital signals, serial data bus formats and data packets.

Communications subsystem 100 may use a conventional Transmission Control Protocol/Internet Protocol ("TCP/IP") data communications protocol with Point-to-Point Protocol ("PPP") communications protocol and Ethernet ports. Communications subsystem 100 may also provide discrete internet protocol ("IP") addresses for both PPP and Ethernet ports. Communications subsystem 100 can be further configured to provide a single Ethernet port and automatically select a conventional 10baseT or 100baseT network connection. In addition, communications subsystem may be connected to a local or wide area network. The bandwidth of data transmitted by communications subsystem 100 may be restricted if desired, in order to limit video traffic on busy networks. Communications subsystem 100 may have a user definable system name and may be configured to automatically request an Ethernet IP address from a DHCP capable network. Access to portable security system 10 via network personal computer ("PC"), PPP, or serial data port can be password-protected for security and privacy purposes, if desired.

Portable security system 10 can be configured to transmit e-mails to predetermined address when system-specific events, faults or alarms occur. Similarly, portable security system 10 may send SMS messages to specified parties when system specific events, faults or alarms occur. Portable security system 10 may also receive queries via SMS messages and respond via SMS with a valid reply to the query.

With reference to FIGS. 1–4 in combination, in operation, portable security system 10 is transported to an area to be secured, such as a construction site. Once located at the site outriggers 18 are pivoted from a generally horizontal position to a generally vertical position and then extended to engage the ground 31 by rotating handles 20. Outriggers 18 thus serve to secure and stabilize portable security system 10 and prevent tipping. Mast 22 is then pivoted to a generally vertical position and secured in the vertical position by any conventional means (not shown) such as bolts, pins, clamps, collars, locks and latches. Mast sections 24 are extended, raising cameras 28 to provide a clear view of the site. Solar panel 32, if provided, may be deployed and oriented such that the solar panel gathers sunlight for conversion to electrical energy for recharging the batteries in battery enclosure 27. Portable security system 10 is optionally connected to a wired or wireless communication link 36 through communications subsystem 100.

Once set up of portable security system 10 is complete, the system may be activated. Indicator lights 42 an exterior surface of cabinet 30 may be included to provide users with a positive indication that portable security system 10 is on and armed. Data from inputs 82 (such as cameras 28) is acquired and routed to data input subsystem 80. Control subsystem 50 instructs server 60 to route the data to data storage 70 for storage. Monitoring personnel at any remote site may then retrieve at least a portion of the stored data at any time for review by issuing a request to control subsystem 50 in a predetermined format, via communication link 36 and communications subsystem 100. Control subsystem 50 in turn instructs server 60 to retrieve the requested data from data storage subsystem 70 and forward it to communications subsystem 100 for transmission to the requester.

In one embodiment data from data storage subsystem 70, such as video, can be flexibly reviewed at varying forward and reverse speeds, single paused images, single-stepping forward and reverse a sequence of images, from a specified time and date, from specific events held in an event database portion of the storage subsystem. Data in data storage subsystem can be cleared as desired.

Alternatively, personnel at a remote location may issue a request to control subsystem 50 to receive real-time input data. Control subsystem 50 accordingly instructs server 60 to forward real-time data received from data input 80 to communications subsystem 100. Communications subsystem 100 transmits the real time data to the requester via a communication link 36. The requested real-time data may concurrently be stored in data storage subsystem 70, if desired.

FIGS. 1–4 may be referred to in combination for the following paragraphs, which detail some example embodiments of the present invention.

In one embodiment of the present invention, the data received by data input 80 may be date and time-stamped to correlate the data to the date and time the data was acquired.

In another embodiment of the present invention, a motion detector 34 (see FIGS. 1 and 2) may be used to detect the presence of unauthorized personnel within a secured area. Motion detector 34 may be used as a manual or automatic trigger for various system functions, such as directing, focusing and zooming cameras 28 towards the region of a detected intruder, sounding alarms such as siren 122, transmitting alerts to monitoring personnel at remote sites, and activating output devices 92 such as floodlights 124.

In yet another embodiment, a communication link 36 may be used to transmit and receive various commands and control functions to and from portable security system 10. For example, monitoring personnel at any remote site may issue commands to configure portable security system 10, monitor input devices 82, activate output devices 92, download data from data storage subsystem 70, change the instructions used by control 50, and reposition cameras 28. Similarly, portable security system 10 may issue system status and component fault information to personnel in a predetermined manner. Example output devices 92 include, without limitation, sirens 122, floodlights 124, signaling devices such as strobe lights 128, electrically actuated devices 130 such as doors, gates and latches, visual and aural alarms and annunciators 136 such as alarm lights and prerecorded messages, camera 28 focusing and servo-motor positioning devices 138, and night vision imaging equipment 140.

In still another embodiment, a global positioning satellite ("GPS") receiver 110 may be made part of portable security system 10. GPS receiver 110 may be used to provide remote monitoring personnel with various data relating to the installation site for portable security system 10, such as position and elevation. Control subsystem 50 may also be configured to receive and interpret National Marine Electronics Association ("NMEA") data from GPS receiver 110. In various embodiments GPS receiver 110 can, via determinable user settings, be adapted to report to remote monitoring personnel via communications subsystem 100 and communication link 36, and log in data storage subsystem 70 the position of portable security system 10 at predetermined distance and/or time intervals. In addition, GPS data may be used to report to remote monitoring personnel via communication link 36 when portable security system 10 is being moved or enters and leaves predetermined areas or zones. GPS receiver 110 may also be adapted to track the location of portable security system 10 with reference to predetermined routes, and reporting to monitoring personnel if the portable security system deviates from those routes by a predetermined amount. The present invention may further encode the NMEA positional, directional and speed readings into each individual image header of a camera 28 image data, enabling moving-map displays on image playback of portable security system 10 on a remote control 120. GPS receiver 110 may also include conventional Wide Area Augmentation System (WAAS) capability for greater positional accuracy. Thus, GPS data can be used to continuously track the location of portable security system 10 both at various points within a particular site and also when the system is being transported between sites. The aforementioned GPS capability may also be used to provide information regarding the accurate location of at least one particular portable security system 10 in an area-securing arrangement which utilizes a plurality of portable security systems.

In accordance with an embodiment of the present invention, portable security system 10 may include Video Motion Detection ("VMD") capability. VMD provides the user with the ability to establish security zones over a predetermined portion of the field of view of at least one specific camera 28, which can be automatically monitored by the portable security system. When an object such as a person or a vehicle passes through the zone, causing a change in the monitored image, portable security system 10 may be adapted to detect the change in the image and undertake a predetermined course of action, such as sounding an alarm and/or notifying remote monitoring personnel via wired or wireless communication links 36, and/or recording a time notation for the event in a database portion of data storage 70.

Portable security system 10 can be configured to secure one or more defined zones. Each zone may be identified by a logical user-determined title so that data for each zone may logically ordered at data input subsystem 80 and/or data storage subsystem 70. Various parameters may be established for securing each zone. For example, alarm input signals from input devices 82 may be used to either trigger an alarm for a particular zone or to inhibit a zone-based alarm. Conditional alarm zones may also be configured, such as requiring two alarm inputs to trigger a zone. Each zone may be linked to any camera 28 for capturing images of a security breach, or create a text only alarm event entry noting the event by control subsystem 50 for storage in data storage subsystem 70. Each alarm zone may record an event, such as a security breach, as a database entry in data storage subsystem 70. Each alarm zone may be configured such that data from input devices 82 for each zone is recorded a slow rate during secured conditions to conserve battery power and the capacity of data storage subsystem 70, and record at a faster rate when a security breach is detected. Each alarm zone may trigger control subsystem 50 to notify a remote control 120 and/or law enforcement personnel in the event of a security breach. Each alarm zone may be individually configured to operate on a 24-hour basis night-time only, or a defined period of time. Data for each zone may be segregated within data storage subsystem 70, and may be individually archived and/or downloaded for review at a remote control 120.

In another embodiment of the present invention, a reference video image of a predetermined portion or zone of an area to be secured may be captured and stored in data storage 70. Subsequent images of the zone may then be periodically captured and compared to the stored reference image. Differences between the reference image and the subsequent images may be analyzed and interpreted by control subsystem 50 in accordance with a set of predetermined instructions, such as a computer program. If the differences fall within predetermined criteria, such as the addition or deletion of particular shapes, changes in lighting, and changes in shading, the analyzed differences may be interpreted as an unauthorized entry, vandalism or theft whereupon portable security system 10 automatically undertakes a predetermined course of action, such as sounding an alarm and/or notifying remote monitoring personnel via wired or wireless communication links 36, or recording a time notation for the event in data storage subsystem 70.

An advantage of portable security system 10 according to an embodiment of the present invention is a capability for the system to function as a standalone unit without auxiliary power for a period of days, such as about ten days or more, without a need for intervention by users or maintenance personnel. Solar array 32 (see FIG. 2) may be used to augment power supply 40 and/or charge batteries in the power supply. In addition, control subsystem 50 may operate in accordance with a predetermined set of instructions, such as a computer program, to turn off various components of portable security system 10 when they are not needed. For example, electrical power may be removed from input devices 82 and cameras 28 that are not being used. Further, subsystems such as data server 60 and data storage 70 may be placed in a standby or "sleep" mode when not needed, in order to conserve power. The various components of portable security system 10 may be turned on and off by control subsystem 50 in this fashion as needed to carry out a predetermined security routine while conserving electrical power. Alternatively, various portions of portable security system 10 may be turned on and off by either local control or remote control by a user via a wired or wireless communication link 36. Other power conservation strategies include extending the operational life of batteries 33 by controlling components within the security system and/or ancillary equipment attached to the system. For example, portable security system can be configured to turn off after a predetermined period of time, when batteries 33 reach a threshold set nominal voltage or a threshold discharge voltage.

Portable security system 10 may be configured with various self-defense capabilities to prevent theft of the system or damage, as well as fending off attempts to defeat the system. For example, cameras 28 and motion detectors 34 may be used to monitor for the presence of unauthorized personnel in proximity to portable security system 10 and undertake a predetermined course of action, such as sounding an alarm and contacting remote monitoring personnel via wired or wireless communication link 36. Additional sensors including, without limitation, audio pickups 126, infrared links 132 and vibration/shock detectors 134 may also be used to detect the presence of unauthorized personnel proximate portable security system 10 and/or attempts to tamper with the portable security system.

A particular advantage of an embodiment of the present invention is its capability for reconfiguration. Various operational parameters of portable security system 10 may be added deleted and changed as needed by appropriate modification of the instructions utilized by control subsystem 50. Operational parameters include, without limitation, areas that are defined as security zones, selection of input devices 82, power control and management, types and frequency of data acquisition, control of output devices 92, types and timing of reports transmitted to remote sites, data storage upload/download, and operational instructions. Thus, the operational aspects of portable security system 10 as described herein may be configured to provide remote accessibility, as well as providing the portable security system with a wide range of options for reconfiguration of operational characteristics such that the operation of the portable security system can be tailored to the needs of a particular site to be secured or modified as the needs of the secured site change.

Portable security system 10 may be configured and/or reconfigured remotely. For example, a conventional network or PPP link may be used. In addition, portable security system 10 can provide diagnostics and debug information via the network connection or PPP dial up. In one embodiment the configuration parameters of portable security system 10 may be set and/or changed using a set of web pages that can be accessed by a network PC using a web browser. Control subsystem 50 may be controlled externally by means of conventional Common Gateway Interface ("CGI") interface commands, enabling integration with various software control packages.

Similarly, the operational parameters of portable security system 10 may be reconfigured locally by a user by means of a local port 104 of communications subsystem 100. Local port 104 may be a conventional computer parallel or serial interface, such as RS232, and may be located within cabinet 30 for protection from the elements and/or tampering. Alternatively, local port 104 may be externally accessible through a hinged or detachable cover that is lockable to prevent tampering. Other local control means include, without limitation, analog and digital controls such as potentiometers and switches.

Likewise, the reconfiguration capability may be used in conjunction with a wired or wireless communication link 36 to enable troubleshooting, fault isolation and repair of portable security system 10. A user may send and receive troubleshooting data to portable security system 10, determine a faulty hardware component, remotely electrically disconnect the faulty component, and remotely electrically connect alternate or spare components. Software problems may likewise be analyzed, isolated and repaired from a remote site by downloading software patches, fixes or new programs to portable security system 10.

Portable security system 10 may be provided with a wide range of configurability parameters. With one parameter, real-time data from input devices 82 can be tailored to suit individual needs. For example, data from camera 28 can be configured for high, medium and low resolution. Use of a lower resolution will reduce the consumption of the capacity of data storage subsystem 70, at the expense of image quality. Data stored in data storage subsystem 70 may be in a standard format compatible with the type of data, such as conventional "MJP" or "AVI" data formats for images, or in a proprietary format. One or more users may remotely access live data at data input subsystem 80 and or data stored in data storage subsystem 70. The live data may be obtained without interrupting storage of the data. A user adjustable rate and duration may be selected, as well as a user adjustable alarm recording rate. Differing recording rates and alarm record rates may be designated for each input device 82. User configurable alarm pre-trigger record rates may be selected for individual input devices 82, as well as pre-trigger pictures for individual input devices. Data storage subsystem 70 may optionally include a user configurable ramdisk to store pre-trigger pictures. A user configurable recorded image resolution may be selected based on the number of pixels sampled. A user configurable recorded image target file size in bytes may be selected. Portable security system 10 may be configured with a predetermined video expiry period, and automatically exclude images that have expired. This conforms to a requirement of some jurisdictions that image data is not to be stored for longer than a set period.

While portable security system 10 provides a capable surveillance platform, a key advantage of the system is its additional capability to secure a predetermined area so as to actively prevent unauthorized personnel from carrying out undesired activities in the secured area. The sensing capabilities of portable security system 10 are used to detect the presence of unauthorized personnel. Unauthorized personnel may be placed on notice of the portable security system by the activation of various output devices 92 to drive off the intruder or intruders. Portable security system 10 may further notify security personnel (such as private security or local police) via communications subsystem 100 and communication link 36 to capture persistent intruders. In one embodiment of the present invention, portable security system 10 may be adapted to forego an annunciated alarm and only alert security personnel (i.e., a "silent alarm"), increasing the chances of capturing the intruders, who may not even be aware of the presence of the portable security system.

Portable security system 10 is easily moved about and set up. Installation of the system requires only that it be moved to a convenient location at the site to be secured. Outriggers 20 are engaged to the ground or other mounting surface to stabilize portable security system 10. If the cameras 28 or other equipment have been removed for transport, they are re-installed. Then, mast 22 is pivoted to an upright position, secured and extended. Any desired auxiliary power and communication links are coupled to system 10, then the system is activated as a "turn-key" to begin securing the area in accordance with a predetermined configuration (i.e., a computer program and associated input and output devices). Since portable security system 10 may be pre-configured and re-configured either locally or from a remote site as discussed above, the portable security system may be quickly and easily set up and deployed by personnel having a only limited knowledge of how to operate the system. In essence, personnel such as a construction crew may simply transport and set up portable security system 10 as discussed above, without a need for complex and time-consuming system configuration. Such configuration may be predetermined by a set of instructions, such as a computer program already stored in control subsystem 50 and/or data storage subsystem 70. Alternately, configuration or re-configuration of portable security system 10 may be accomplished at any time by a user, either locally or at a remote site via wired or wireless communication means 36. This capability also allows for tailoring of portable security system 10 to the characteristics of a particular site, and to change operational parameters of the portable security system as needed, as the characteristics of the site become better known or the characteristics of the site change, such as a demolition or construction site.

Portable security system 10 may be used to secure either an interior or exterior site. In many cases, the portable security system will be exposed to the elements. As such, portable security system 10 is adapted to withstand the extremes or weather, including low and high temperatures, precipitation, and solar energy. Residual heat generated by at least some of the components in cabinet 30 is used to help warm all of the components during operation in cold temperatures, aiding to keep the components within their rated operating temperature range. A supplemental heating device, controlled by control subsystem 50, may optionally be added. Various conventional devices may be employed to maintain the operating temperature of components of the system within a desired range, such as thermostatically-controlled heaters and fans (not shown). The heaters and fans may also be controlled locally by control subsystem 50 in cooperation with temperature sensors located at one or more points of portable security system 10 or remotely using wireless communication means 36.

A plurality of portable security systems 10 may be employed to secure a site. Accordingly, a remote control 120 may be used to monitor and control the plurality of portable security systems 10 at a particular site or at plurality of sites. In these embodiments of the present invention, each portable security system 10 of a multi-system arrangement is adapted to transmit and receive signals in a conventional addressed format, such that each portable security system responds only to control signals corresponding to a predetermined address or other unique identifier for that system received via communication link 36. Alternatively, a plurality of communication links 36 may be used to individually communicate with each portable security system 10. Remote control 120 provides means for obtaining data relating to portable security system 10.

If portable security system 10 is deployed in an area not having wireless internet service, data from the system can be obtained with a conventional "wireless G" type connection operating in "infrastructure mode." To accomplish this a user configures communications subsystem 100 with a wireless Ethernet interface and an associated computer program to operate the Ethernet interface. The Ethernet interface and computer program will survey for available connections and will locate a default "infrastructure" connection. The user then launches a computer program resident on a remote control 120 and enters the address of the portable security system 10 to be contacted. The corresponding portable security system 10 will respond by asking for a username and password. Once the proper user name and password are entered, live and recorded video from portable security system 10 will be available for viewing and download. If portable security system 10 is to be used as part of a networked hub, it can be combined with other like units to secure a large area, perimeter, or a line of sight such as a border or property line. Each portable security system 10 can be programmed with a specific IP address and can be monitored or interrogated from a remote position. By using multiple portable security systems 10, a large area can be secured.

If portable security system 10 is deployed in an area having internet service, data can be sent to and received from the system via a standard "Wireless G" type communication link 36 operating in "infrastructure mode." To accomplish this a user configures communications subsystem 100 with a wireless Ethernet interface. Communications subsystem 100 is configured with a fixed address that can be accessed via the internet. The user then launches a computer program on a remote control 120 connected to the internet and enters the address of the portable security system 10 to be contacted. The selected portable security system 10 will then respond by asking for a user name and password. Once the proper user name and password are entered, live and stored data, such as video data, will be available for viewing and download from virtually anywhere in the world. A similar connection can be configured by use of a wireless modem.

Some cities and urban areas are now being supplied with relatively long-range wireless Ethernet service. The area of service of one of these access points is generally referred to as a "Hot Zone." With a portable security system 10 deployed within one of these areas, data can be sent to and received from one or more portable security systems after making arrangements with the provider of the hot zone to utilize the service. Once access to the hot zone is available, data can be sent to and received from security systems 10 over the internet. The user launches an associated computer program on a remote control 120 connected to the internet and enters the address of the portable security system 10 to be contacted. Portable security system 10 will respond by asking for a user name and password. Once the proper user name and password are entered, data such as live and recorded video will be available for viewing and download from virtually anywhere in the world.

In another embodiment of the present invention portable security system 10 may be adapted to operate autonomously in accordance with a predetermined set of instructions, such as a computer program. Aspects of autonomous operation may include, without limitation, operation in accordance with a predetermined configuration, automatically altering operational aspects of portable security system 10 in response to external stimuli such as changes in the status of input devices 82, automatically detecting, isolating and repairing internal faults, and automatically altering operational aspects in response to internal conditions, such as temperature and battery capacity.

Portable security system 10 can be variously configured to send data to a remote control 120 upon the occurrence of an event, such as an alarm input, at a set time, at set data storage capacity levels, or whenever the system is connected to a remote control.

Portable security system 10 can be configured to maintain log files relating to operational parameters, all connections to the system from remote controls 120, illegal attempts to access data, all web pages of the system, e-mails, sent messages, received SMS messages, and FTP downloads. Portable security system 10 may also maintain an anonymous FTP log of all anonymous FTP logs.

Portable security system 10 may also be used as a support tool for a construction project. As previously discussed, remotely-located personnel, such as engineers and architects, may utilize portable security system 10 to monitor activities and progress at the site, either in real-time or from data stored in data storage subsystem 70. If problems arise at the site, remotely-located personnel may use portable security system 10 to gather data needed to resolve the problem. For example, if there are apparent defects in building materials delivered by a supplier, remotely located personnel may use a video input from a camera 28 to inspect the materials and make a determination as to their acceptability, thereby minimizing time delays caused by a need for the personnel to travel to the site and inspect the materials. Other support-related activities utilizing portable security system 10 may include use as a "site management tool" to keep records of crew arrivals, departures and activities, as well as material deliveries and consumption.

While this invention has been shown and described with respect to a detailed embodiment thereof, it will be understood by those skilled in the art that various changes in form and detail thereof may be made without departing from the scope of the claims of the invention.

What is claimed is:

1. A portable security system, comprising:

a wheeled trailer;

a telescopic mast coupled to the trailer and pivotable between a first generally horizontal retracted position and a second generally vertical extended position;

a cabinet mounted onto the trailer;

a control subsystem, a data input subsystem, a data server and a data storage subsystem arranged within the cabinet;

at least one input device connected to the data input subsystem;

a communications subsystem to receive data from an external control and to transmit data to the external control; and a communication link to couple the communications subsystem to a remote external control, wherein the data input subsystem receives data from the input device and forwards the data to the data storage subsystem for storage by means of the data server, and wherein the control subsystem monitors the status of the input device by means of the data input subsystem and notifies the remote external control by means of the communication subsystem and communication link if the status of the input device changes in a predetermined manner.

2. The portable security system of claim 1 wherein the input device is at least one of a camera, microphone, smoke detector, vibration/shock sensor, motion sensor, light detector, infrared transmitter/receiver, contact switch and text-generating device.

3. The portable security system of claim 1, further comprising a battery power supply mounted onto the trailer to supply power to the portable security system.

4. The portable security system of claim 3 further comprising a solar panel to at least one of charge the battery power supply and augment the battery power supply.

5. The portable security system of claim 3 wherein the control subsystem operates in accordance with a predetermined set of instructions to conserve battery power.

6. The portable security system of claim 1, further comprising an output subsystem wherein one or more output devices are actuable by the control subsystem by means of the output subsystem.

7. The portable security system of claim 6 wherein the output device is at least one of a siren, floodlight, indicator light, electrically actuated device, alarm, annunciator, and strobe light.

8. The portable security system of claim 1 wherein the communication link is at least one of a wired data network, a wireless data network, a cellular telecommunications system, a telephone telecommunications system and a satellite telecommunications system.

9. The portable security system of claim 8 wherein at least one of data received by the data input subsystem and data stored in the data storage subsystem are forwarded to the communications subsystem by the data server and delivered to the remote external control by the communication link.

10. The portable security system of claim 1 wherein at least one of predetermined instructions and commands from the remote external control are forwarded to the portable security system by the communication link and are acted upon by the control subsystem.

11. The portable security system of claim 1 wherein at least one input device is used to establish at least one security zone.

12. A portable security system, comprising:

a wheeled trailer;

a telescopic mast coupled to the trailer and pivotable between a first generally horizontal retracted position and a second generally vertical extended position;

a cabinet mounted onto the trailer;

a control subsystem, a data input subsystem, a data server and a data storage subsystem arranged within the cabinet;

at least one input device connected to the data input subsystem; and a GPS receiver to provide the control subsystem with information relating to the position of the portable security system, wherein the data input subsystem receives data from the input device and forwards the data to the data storage subsystem for storage by means of the data server.

13. The portable security system of claim 12 wherein the control subsystem notifies a remote external control by means of the communication subsystem and the communication link if the position of the portable security system changes by a predetermined distance.

14. A portable security system, comprising:

a wheeled trailer;

a telescopic mast coupled to the trailer and pivotable between a first generally horizontal retracted position and a second generally vertical extended position;

a cabinet mounted onto the trailer;

a control subsystem, a data input subsystem, a data server, an output subsystem and a data storage subsystem arranged within the cabinet;

a battery power supply mounted onto the trailer to supply power to the portable security system;

at least one input device connected to the data input subsystem;

at least one output device that is actuable by the control subsystem by means of the output subsystem;

a communication subsystem to receive data from an external control and to transmit data to the external control; and a communication link to couple the communication subsystem to a remote external control, wherein the data input subsystem receives data from the input device and forwards the data to the data storage subsystem for storage by means of the data server, wherein the control subsystem actuates an output device in response to a change in the status of an input device, and wherein the control subsystem monitors the status of the input device by means of the data input subsystem and notifies the remote external control by means of the communication subsystem and communication link if the status of the input device changes in a predetermined manner.

15. The portable security system of claim 14 wherein at least one of data received by the data input subsystem and data stored in the data storage subsystem are forwarded to the communications subsystem by the data server and are delivered to the remote external control by the communication link.

* * * * *

US007193508C1

(12) EX PARTE REEXAMINATION CERTIFICATE (8047th)

United States Patent

Hill et al.

(10) Number: US 7,193,508 C1

(45) Certificate Issued: Feb. 22, 2011

(54) PORTABLE SECURITY SYSTEM

(75) Inventors: Philip A. Hill, Urbana, OH (US); Steven M. Schneider, Urbana, OH (US)

(73) Assignee: Cameras Onsite, LLC, Houston, TX (US)

Reexamination Request:
No. 90/010,707, Oct. 9, 2009

Reexamination Certificate for:

| | |
|---|---|
| Patent No.: | **7,193,508** |
| Issued: | **Mar. 20, 2007** |
| Appl. No.: | **11/056,690** |
| Filed: | **Feb. 11, 2005** |

Related U.S. Application Data

(60) Provisional application No. 60/544,008, filed on Feb. 12, 2004.

(51) Int. Cl.
*G08B 21/00* (2006.01)

(52) U.S. Cl. ..... 340/431; 340/506; 340/517; 340/521

(58) Field of Classification Search ..... None
See application file for complete search history.

(56) References Cited

U.S. PATENT DOCUMENTS

| | | | |
|---|---|---|---|
| 4,332,980 | A | 6/1982 | Reynolds et al. |
| 4,815,757 | A | 3/1989 | Hamilton |
| 4,913,458 | A | 4/1990 | Hamilton |
| 5,257,007 | A | 10/1993 | Steil et al. |
| 5,587,701 | A | 12/1996 | Hess |
| 5,777,551 | A | 7/1998 | Hess |
| 5,819,124 | A | 10/1998 | Somner et al. |
| 5,982,418 | A | 11/1999 | Ely |
| 6,056,450 | A | 5/2000 | Walling |
| 6,246,320 | B1 | 6/2001 | Monroe |
| 6,375,370 | B1 | 4/2002 | Wesselink et al. |
| 6,392,692 | B1 | 5/2002 | Monroe |
| 6,457,129 | B2 | 9/2002 | O'Mahoney |
| 6,582,105 | B1 | 6/2003 | Christensen |
| 6,585,428 | B1 | 7/2003 | Wesselink et al. |
| 6,709,171 | B2 | 3/2004 | Wesselink et al. |
| 6,709,172 | B2 | 3/2004 | Brown |
| 6,735,630 | B1 | 5/2004 | Gelvin et al. |
| 6,774,782 | B2 | 8/2004 | Runyon et al. |
| 6,784,833 | B1 | 8/2004 | Evans |
| 6,798,343 | B2 | 9/2004 | Carrier et al. |
| 6,940,404 | B2 | 9/2005 | Nagao et al. |
| 6,963,279 | B1 | 11/2005 | Martinelli et al. |
| 7,059,783 | B1 | 6/2006 | Wesselink et al. |
| 7,062,221 | B1 | 6/2006 | Christensen |

(Continued)

OTHER PUBLICATIONS

Lawrence A. Klein, "Final Report: Mobile Surveillance and Wireless Communication Systems Field Operational Test", vol. 1, California PATH Research Report, ISSN 1055–1425, Mar. 1999 <<http://www.path.berkeley.edu/PATH/Publications/PDF/PRR/99/PRR–99–06.pdf>>.

Lawrence A. Klein, "Final Report: Mobile Surveillance and Wireless Communication Systems Field Operational Test", vol. 2, California PATH Research Report, ISSN 1055–1425, Mar. 1999 <<http://www.path.berkeley.edu/PATH/Publications/PDF/PRR/99/PRR–99–07.pdf>>.

Lawrence A. Klein, "Final Report: Mobile Surveillance and Wireless Communication Systems Field Operational Test", vol. 3, California PATH Research Report, ISSN 1055–1425, Mar. 1999 <<http://www.path.berkeley.edu/PATH/Publications/PDF/PRR–99–08.pdf>>.

*Primary Examiner*—Lynne H. Browne

(57) ABSTRACT

A portable security system. The portable security system includes a wheeled trailer and a telescopic mast that is coupled to the trailer. The mast is pivotable between a first generally horizontal retracted position and a second generally vertical extended position. A cabinet is mounted onto the trailer and houses a control subsystem, a data input subsystem, a data server and a data storage subsystem. At least one input device is connected to the data input subsystem. The data input subsystem receives data from the input device and forwards the data to the data storage subsystem for storage by means of the data server.

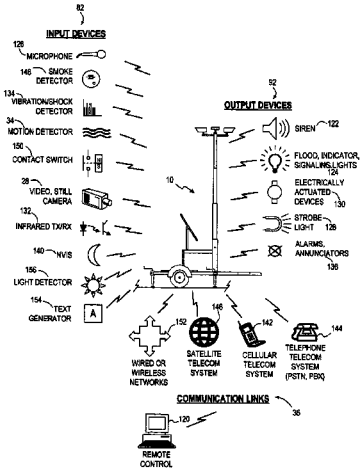

U.S. PATENT DOCUMENTS

| | | | |
|---|---|---|---|
| 7,111,997 | B2 | 9/2006 | Wesselink et al. |
| 7,267,496 | B2 | 9/2007 | Wesselink et al. |
| 7,349,025 | B2 | 3/2008 | Wong |
| 7,429,139 | B2 | 9/2008 | Wesselink et al. |
| 7,465,108 | B2 | 12/2008 | Brown |
| 2003/0025791 | A1 | 2/2003 | Kaylor |
| 2008/0012941 | A1 | 1/2008 | Brown |
| 2008/0100707 | A1 | 5/2008 | Brown |

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1-13 are cancelled.

Claims 14 and 15 are determined to be patentable as amended.

New claims 16-21 are added and determined to be patentable.

14. A portable security system, *configured to communicate with a remote external control comprising one or more of a computer, a microprocessor, a microcomputer, or a central processing unit, the portable security system* comprising:

a wheeled trailer;

a telescopic mast coupled to the trailer and pivotable between a first generally horizontal retracted position and a second generally vertical extended position;

a cabinet *exposed to the environment and* mounted onto the trailer;

a control subsystem, a data input subsystem, a data server, an output subsystem and a data storage subsystem arranged within the cabinet, *wherein the control subsystem comprises one or more of a computer, a microprocessor, a microcomputer, or a central processing unit*;

a battery power supply mounted onto the trailer to supply power to the portable security system;

at least one input device connected to the data input subsystem;

at least one output device *at the same location as the cabinet and trailer* that is actuable by the control subsystem by means of the output subsystem;

a communication subsystem to receive data from [an] *said remote* control and to transmit data to the *remote* external control; and a communication link to couple the communication subsystem to the remote external control, wherein the data input subsystem receives data from the input device and forwards the data to the data storage subsystem for storage by means of the data server, wherein the control subsystem actuates the output device in response to a change in the status of the input device, and wherein the control subsystem monitors the status of the input device by means of the data input subsystem and notifies the remote external control by means of the communication subsystem and communication link if the status of the input device changes in a predetermined manner.

15. The portable security system of claim 14 wherein at least [one of] *some* data received by the data input subsystem [and data stored in the data storage subsystem] *is* forwarded to the communications subsytem by the data server and [are] delivered to the remote external control by the communication link.

*16. A portable security system configured to communicate with a remote external control comprising one or more of a computer, a microprocessor, a microcomputer, or a central processing unit, the portable security system comprising:*

*a wheeled trailer;*

*a telescopic mast coupled to the trailer and pivotable between a first generally horizontal retracted position and a second generally vertical extended position;*

*a cabinet exposed to the environment and mounted onto the trailer;*

*a control subsystem, a data input subsystem, a data server and a data storage subsystem arranged within the cabinet, wherein the control subsystem comprises one or more of a computer, a microprocessor, a microcomputer, or a central processing unit;*

*at least one input device connected to the data input subsystem;*

*a communications subsystem to receive data from said remote external control and to transmit data to the remote external control; and*

*a communication link to couple the communications subsystem to the remote external control,*

*wherein the data input subsystem receives data from the input device and forwards the data to the data storage subsystem for storage by means of the data server,*

*wherein the control subsystem monitors the status of the input device by means of the data input subsystem and notifies the remote external control by means of the communication subsystem and communication link if the status of the input device changes in a predetermined manner,*

*wherein predetermined instructions from the remote external control are received by the portable security system via the communication link and acted upon by the control subsystem;*

*wherein the communication link is at least one of a wired data network, a wireless data network, a cellular telecommunications system, a telephone telecommunications system and a satellite telecommunications system; and*

*wherein at least some data stored in the data storage subsystem is stored for later access and can be later accessed and forwarded to the communications subsystem by the data server and delivered to the remote external control by the communication link.*

*17. The portable security system of claim 14 wherein at least some data stored in the data storage subsystem is stored for later access and can be later accessed and forwarded to the communications subsystem by the data server and delivered to the remote external control by the communication link.*

*18. A portable security system configured to communicate with a remote external control comprising one or more of a computer, a microprocessor, a microcomputer, or a central processing unit, the portable security system comprising:*

*a wheeled trailer;*

*a telescopic mast coupled to the trailer and pivotable between a first generally horizontal retracted position and a second generally vertical extended position;*

*a cabinet exposed to the environment and mounted onto the trailer;*

*a control subsystem, a data input subsystem, a data server and a data storage subsystem arranged within the cabinet, wherein the control subsystem comprises one or more of a computer, a microprocessor, a microcomputer, or a central processing unit;*

*at least one input device connected to the data input subsystem;*

*a communications subsystem to receive data from said remote external control and to transmit data to the remote external control, and*

*a communication link to couple the communications subsystem to the remote external control,*

*wherein the data input subsystem receives data from the input device and forwards the data to the data storage subsystem for storage by means of the data server,*

*wherein the control subsystem monitors the status of the input device by means of the data input subsystem and notifies the remote external control by means of the communication subsystem and communication link if the status of the input device changes in a predetermined manner,*

*wherein predetermined instructions from the remote external control are received by the portable security system via the communication link and acted upon by the control subsystem; and*

*wherein at least some data stored by the data storage subsystem is video data stored so that it can be later accessed.*

*19. The portable security system of claim 14 wherein at least some data stored by the data storage subsystem is video data stored for later access.*

*20. The portable security system of claim 16 wherein at least some of the data stored in the data storage subsystem is stored for later access and can be later accessed and forwarded to the communications subsystem by the data server and delivered to the remote external control by the communication link is video data.*

*21. The portable security system of claim 18 wherein at least some of the data stored in the data storage subsystem is stored for later access and can be later accessed and forwarded to the communications subsystem by the data server and delivered to the remote external control by the communication link is video data.*

* * * * *